US005241931A

United States Patent [19]

Radel

[11] Patent Number: 5,241,931

[45] Date of Patent: Sep. 7, 1993

[54] INTERNAL-COMBUSTION ENGINE WITH A CARBURETOR

[75] Inventor: Harry Radel, Geesthacht, Fed. Rep. of Germany

[73] Assignee: Sachs-Dolmar GmbH, Hamburg, Fed. Rep. of Germany

[21] Appl. No.: 722,329

[22] Filed: Jun. 28, 1991

[30] Foreign Application Priority Data

Jun. 30, 1990 [DE] Fed. Rep. of Germany ..... 4020947

[51] Int. Cl.[5] ..... F02M 1/16; F02M 37/04

[52] U.S. Cl. ..... 123/179.14; 123/514; 261/35; 261/DIG. 68

[58] Field of Search ..... 123/514, 516, 179.14, 123/179.7; 261/DIG. 68, DIG. 8, 81, 35

[56] References Cited

U.S. PATENT DOCUMENTS

| | | | |
|---|---|---|---|
| 1,891,238 | 12/1932 | Oswald | 123/514 |
| 2,977,948 | 4/1961 | Rittler | 123/179.14 |
| 3,706,444 | 12/1972 | Masaki | 123/179.14 |
| 4,656,987 | 4/1987 | Arpaia | 123/516 |
| 4,784,096 | 11/1988 | Eberline | 123/179.14 |
| 4,824,613 | 4/1989 | Scott . | |
| 4,862,847 | 9/1989 | Kobayashi | 123/179.14 |
| 4,986,239 | 1/1991 | Suzuki | 123/179.14 |
| 5,121,719 | 6/1992 | Okazaki | 123/179.14 |

FOREIGN PATENT DOCUMENTS

| | | |
|---|---|---|
| 0236858 | 2/1987 | European Pat. Off. . |
| 0285708 | 12/1987 | European Pat. Off. . |
| 8710075 | 12/1988 | Fed. Rep. of Germany . |
| 2564903 | 11/1985 | France . |
| 2582733 | 12/1986 | France . |
| 2207467A | 2/1989 | United Kingdom . |

*Primary Examiner*—Carl S. Miller
*Attorney, Agent, or Firm*—Townsend and Townsend

[57] ABSTRACT

An internal combustion engine with a diaphragm carburetor which provides additional fuel injection in all starting and environmental conditions. The carburetor is provided with a fuel recirculation line which communicates at one end with the fuel feed line of the carburetor, and which communicates at the other end with the fuel tank. The recirculation line is also provided with a choke for flow resistance.

9 Claims, 7 Drawing Sheets

INTERNAL-COMBUSTION ENGINE WITH A CARBURETOR

BACKGROUND OF THE INVENTION

The present invention relates to an internal-combustion engine with a carburetor. More particularly, the present invention relates to an engine with a diaphragm carburetor which, in order to form a starting and control device, is provided with an additional drilled injection passage which communicates with the fuel line via a flow-controllable feed line.

Internal-combustion engines have been known for a long time in many areas of application and, more particularly, for use in power chain saws. For the operation of an internal-combustion engine it is necessary to supply air and fuel at a specific ratio for each operating level, depending upon rotational speed and load. The function of the carburetor is to apportion the correct amount of fuel to the air drawn in and to effect the proportioning of the volume of the air-fuel mixture necessary for adjusting the operating level. This preparation and supplying of the internal-combustion engine with an appropriate fuel-air mixture is, for the most part, possible to carry out without any difficulties during the operation of the internal-combustion engine.

For the cold start or the dry start, i.e., the start subsequent to the carburetor having dried out in an internal-combustion engine which has previously been strongly heated, starting devices are required. Such devices provide a very rich fuel-air mixture since, in order to compensate for the poor evaporation under cold start conditions, an increased amount of fuel must be supplied to the internal-combustion engine until it starts running. In addition, the starting devices enrich the mixture to the necessary extent until the normal operating temperature of the internal-combustion engine is reached.

Typical starting devices are constructed in the form of choke valve starters, in which, in order to bring about the start, the choke located before the Venturi tube is closed and, at the same time, the throttle flap is opened a little. The reduced induction pipe pressure then acts upon the main jet system and it supplies the additionally necessary fuel.

The use of such a choke system is subject to difficulties particularly when a diaphragm pump acted upon by pressure pulses is used as a fuel pump which, in turn, is acted upon by the power surges in the crankcase of, for example, a two-stroke engine. Due to the closing of the choke, a pressure equilibrium is established in each case between the fuel pump, the fuel flow area and the intake area communicating with the cylinder in such a way that the flow of fuel does not begin or begins only to a very limited degree. In internal-combustion engines intended to be started with the aid of manually actuated starting devices, this results in a considerable starting effort which reduces the handling comfort of such an internal-combustion engine.

Moreover, the choke mounted in the intake portion, during the normal operation of the internal-combustion engine, i.e., subsequent to the starting phase, develops a significant flow resistance. This flow resistance leads to substantial compromises in the carburetor design and the ensuing disadvantages cannot be completely eliminated. Thus, for instance, it is not possible to completely eliminate the additional turbulence of the air entering through the choke.

It would be advantageous to construct the internal-combustion engine and/or the carburetor in such a way that it would be possible to carry out a cold start or a dry start without requiring a choke.

Especially when diaphragm carburetors are employed, such as in power chain saws, control malfunctions frequently occur. Thus, at high carburetor temperatures, e.g., above 50° C., problems arise in the fuel supply. These problems or malfunctions are, as a rule, caused by evaporating fuel since the vaporous fuel, on the fuel side, presses upon the regulating diaphragm, whereby the control valve, which is generally constructed in the form of a needle valve, is closed. At temperatures ranging from 25° C. to 30° C., for instance, the carburetor on a power chain saw is, in operation, heated to approximately 65° C. within a period of approximately 10 minutes.

When such a heating of the carburetor takes place and, with it, of the entire fuel conveyance routes, a substantial evaporation of fuel then occurs such that a starting of the engine is no longer possible. An enforced cooling interval of at least 20 minutes is then required. Thus, the utilization possibilities of chain saws, particularly in summer, are severely restricted, especially since it is impossible to make provision for such a chain saw to remain in uninterrupted operation. The existing possibility of keeping the internal-combustion engine of the power chain saw operative in the interval periods at idling speeds is no longer acceptable for reasons related to environmental protection, such as exhaust gas annoyance, noise nuisance, and waste of energy.

An increased spatial separation of the carburetor from the cylinder head of the internal-combustion engine results in disadvantages due to the correspondingly longer flow paths.

Prior solutions to this problem have been to provide a more substantial heat insulation between the carburetor and the cylinder of the internal-combustion engine. However, this solution is subject to the disadvantage that, at colder temperatures when a heating of the carburetor by the cylinder of the internal-combustion engine is desired, icing up of the carburetor takes place.

In order to solve the problems to which attention has been drawn in the foregoing, more particularly the problem of the cold start, prior art solutions have also been proposed which fit an additional manual primer to the carburetor. However, the structural and space-related effort connected herewith has proved to a disadvantage. Further, this solution, too, has so far not led to the desired results since a formation of vapor bubbles could not be prevented by this. Moreover, with a primer, an adjustment is no longer possible once the internal-combustion engine has started running. Also, an exact apportionment of fuel is not feasible by this means so that the problem of the engine becoming flooded is ever-present.

Due to the foregoing considerations, an internal-combustion engine of the type stated in the beginning has already been proposed; (see, for example, German Patent Number DE-GM 87 10 075). Tank recirculation devices are also already known.

However, it is the object of the present invention to further develop an internal-combustion engine in such a way that additional priming under all starting and environmental condition results in a start without any difficulties.

This technical problem is solved by the features embodied in the present invention.

SUMMARY OF THE INVENTION

According to one embodiment of the present invention, a starting and controlling device is provided which, without the actuation or operation of additional means, effectively supplies fuel under all environmental and operational conditions, i.e., independently of the ambient temperatures and of the operational temperatures of the internal-combustion engine. Also provided is a drilled passage which may be selected to be within the entire mixture preparation and mixture feed area and should be chosen in accordance with the special dispositional profile of the internal-combustion engine, for what is essential is that, independently of the main jet and underload jet system, additional fuel is conveyed to the outlet area.

By way of example, with the construction of the internal-combustion engine according to the invention, a cold start is possible even with a dry carburetor without additional starting means. The necessary enrichment is effected directly via the supply line in the underload jet chamber so that, at a normal low pressure, the fuel-air mixture is substantially enriched such that a cold start becomes possible. Power chain saws powered by internal-combustion engines having conventional starting devices and diaphragm carburetors often start running, but subsequently the engine becomes excessively enriched so rapidly that it becomes flooded and then has to be started again without any actuation of the choke. This disadvantage does not arise in the present system since a controlled supply of fuel is possible. Since a starting device is dispensed with, a fuel supply with the aid of the fuel pump is ensured with the first actuation of the starter so that an ignitable mixture is quickly made available in a dry or a cold carburetor.

A further significant advantage of the present invention is that a choke in the form of a choke flap is no longer necessary and, since the choke is dispensed with, the flow conditions inside the carburetor are considerably improved. It is also possible to thereby reduce the diameter of the Venturi jet constructed in the carburetion portion, which greatly improves the performance characteristics of the engine.

In the case of a hot start, an effective starting possibility has been provided with the internal-combustion engine according to the invention. The operational or starting troubles occurring at carburetor temperatures in excess of 50° C., which are caused by fuel evaporating within the control section of the carburetor, are eliminated by the feed line acting in the form of a by-pass. By means of the by-pass, the needle valve, which may be blocked by the pressurized control diaphragm, is circumvented. The feed line connects the pressurizable fuel supply line and, thus, the pressure area of the fuel pump directly to the underload jet chamber. With the aid of this by-pass the engine can be started reliably and easily, even with a carburetor temperature of 65° C., by two to four starting attempts at the halfway throttle position. At high carburetor temperatures, previously known power chain saws driven by internal-combustion engines with diaphragm carburetors require a cooling interval of at least 20 minutes, or at least fifty starting attempts in order to achieve a cooling of the carburetor with the aid of the aspirated intake air. Thus, reliable starting of the internal-combustion engine is unlikely.

Since, in the case of a hot start, after approximately 5 to 10 seconds operating time, the carburetor has reached its operating temperature, which is below 50° C., the by-pass is closed. The feed line is constructed so as to be flow-controllable and blockable with the aid of a controller. Blocking the feed line, for the normal operating condition, removes the influence of the line on the function of the carburetor and, thereby, on the operational behavior. It is likewise possible to provide that, for certain operating conditions, the regulation of the main fuel mixture control is blocked and fuel apportionment only takes place via the by-pass.

Since the fuel pump is only minimally suited for delivering a compressible medium, such as air, against small exhaust cross sections (injection nozzle), the exhaust with the throttled fuel recirculation is expanded to $\geqq 300\%$. In normal operation with the existing fuel supply, this does not present any problem. In order to achieve a facilitation of the starting operation, various embodiments of this fuel pump venting or fuel tank recirculation are possible.

If the tank return flow is self-contained, an improved venting of the fuel pump during the starting operation is possible. A limited pressure buildup in the tank is admissible in the process since the gas pressure is reduced when the needle valve is opened by means of the return flow throttle and the additional injection nozzle.

This embodiment produces a reliable start at a normal temperature around 20° C. with 2–3 starting attempts. With a cold engine (−25° C.), approximately 8 starting attempts are necessary.

The present invention provides an improved flow behavior after a start has taken place with a choke so that an automatic switching-off means for the choke device is unnecessary.

It is possible, furthermore, to provide for a suction primer to be fitted in the fuel return line. Preferably, a fuel pump venting by means of a connecting fitting with a choke bore is effected from the fuel pressure area of the carburetor via the primer with nonreturn check valve to the tank. In the case of less favorable starting conditions, following a single actuation of the primer at halfway throttle position and with opened check valve, the engine may be started after one starting attempt. This is made possible by venting the fuel pump prior to the starting attempt by actuating the suction primer. A preferred primer may be a manually actuatable pump in combination with two valves, such that a delivery in one conveying direction is possible.

Alternatively, the present invention may provide for a primer to be mounted in the fuel line between the tank and the carburetor. The fuel pump is vented by the actuation of this primer. If necessary, fuel may be injected into the mixture preparation area directly, via the additional drilled injection passage into the induction port, whereby the number of starting attempts at a low temperature start (e.g., $T \leqq -10°$ C.) is substantially reduced.

BRIEF DESCRIPTION OF THE DRAWINGS

Further advantageous embodiments are explained in greater detail in the following description, with the aid of the drawings, in which.

DESCRIPTION OF THE PREFERRED EMBODIMENT

Figure 1:
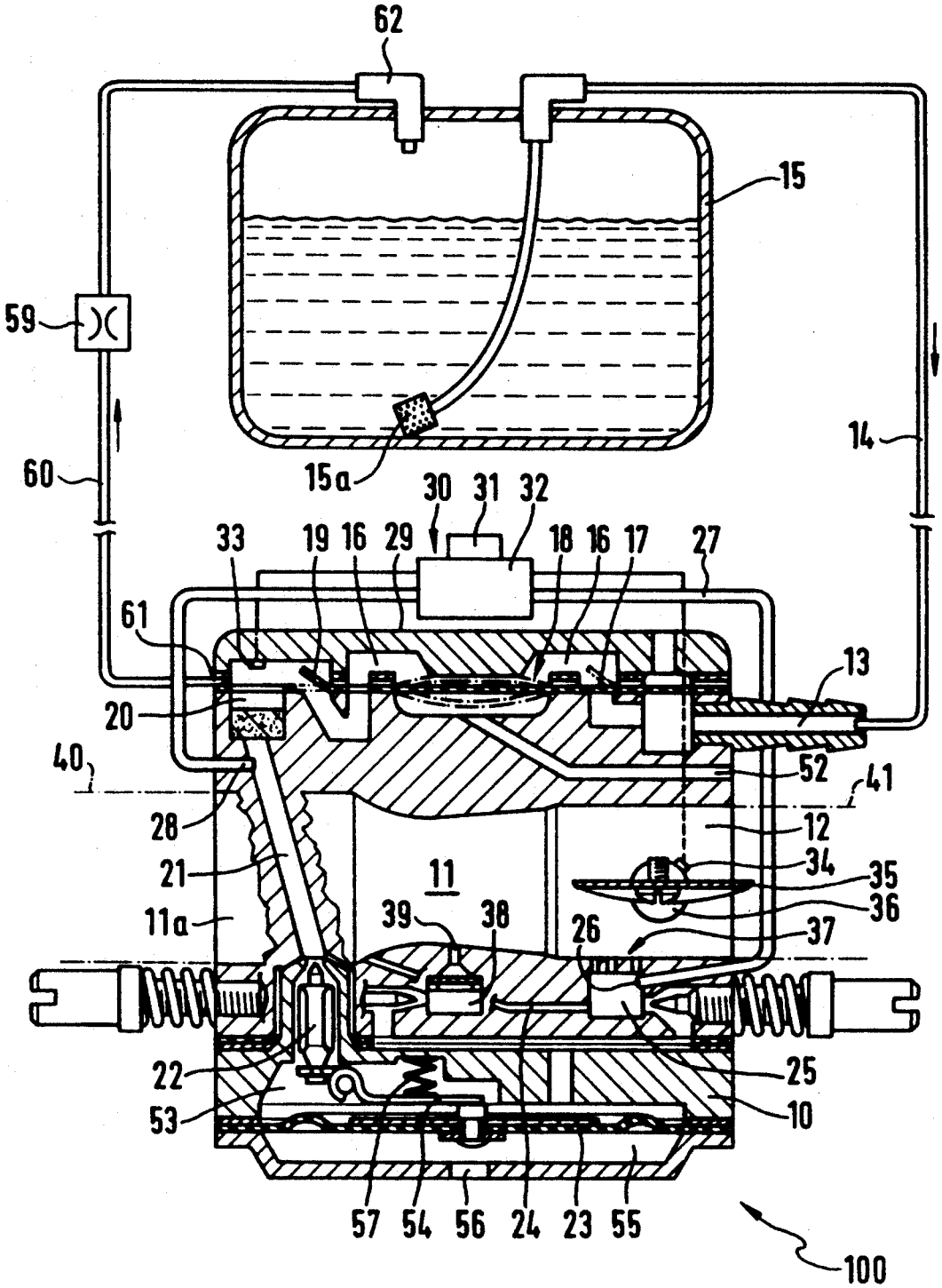
FIGS. 1–3, in diagrammatical representations, show three embodiments of the communication between the diaphragm carburetor according to the present invention, and a fuel tank.

The diaphragm carburetor 100 depicted in FIGS. 1 through 4 of an internal-combustion engine not shown in the drawings, comprises a housing 10 in which the carburetion portion (Venturi) 11, the pre-inserted intake portion 11*a* and the post-inserted choke portion 12 are disposed. The fuel supply connection piece 13 communicates via a fuel line 14 with a tank 15 and, in the carburetor, with the fuel feed line 16. Disposed within fuel feed line 16, in a consecutive arrangement, are a diaphragm pump chamber inlet valve 17, a diaphragm pump 18 and a diaphragm pump chamber outlet valve 19. The fuel which enters via the fuel supply connection piece 13 is pumped in a pressurized state by the fuel pump 18 into the filter chamber 20 and, is conducted therefrom via the control line 21, to the needle valve 22 which is regulated by the control diaphragm 23. Simultaneously, the fuel is piped in via pertinent supply lines 24 of the underload jet chamber 25.

Inside the underload jet chamber 25, a drilled injection passage 26 is constructed in the form of a jet which, on the outside of the housing, is connected to the feed line 27. The feed line 27, at its other end, communicates with the feed line connection piece 28 which is disposed in such a way as to project into the control chamber feed line 21 inserted behind the filter chamber 20. Along the course of the feed line 27, in the outside 29 of the housing 10, a controller 30 is fitted, which is constructed in the form of a check valve 32 regulated by means of a control switch 31. In this embodiment, a sensor 33 of the control switch 31 is disposed in the interior of the filter chamber 20, while a second sensor 34 is disposed on the throttle valve 35, on the throttle valve spindle 36 or on a throttle valve mechanism which is not depicted in the drawing. In this case the control switch 31 is provided with a relevant control mechanism and an electronic regulating means.

The drilled passage 26, in order to render possible an additional fuel supply via the feed line 27 and so as to avoid flooding the underload jet chamber 25, is constructed so as to be smaller in comparison with the jet or jets 37 of the underload jet chamber 25.

The controller 30 and, in communication therewith, the feed line 27, do not necessarily have to be disposed in the manner indicated in the drawing. Alternatively, it may be advantageous if the controller 30, especially if it is constructed in the form of a manually actuatable check valve, is mounted on a housing surface (not shown) of a casing of a power chain saw. For the cold and hot start means to function properly, it is important that the feed line 27 is connected to the pressurized part of the fuel supply of the diaphragm carburetor and that additional fuel injection takes place via the feed line 27, by way of example, into the underload jet area in the throttle valve portion 12 of the diaphragm carburetor.

Figure 7:
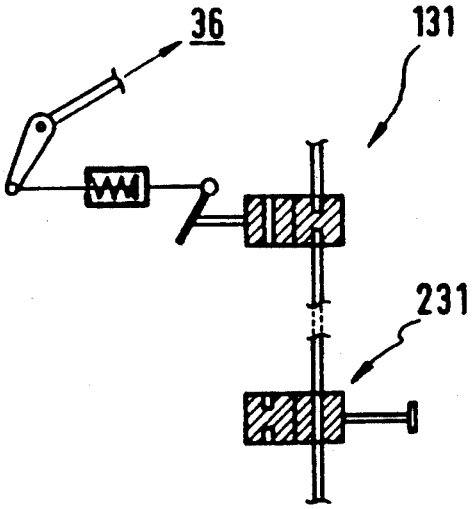
FIG. 7, in an enlarged diagrammatical representation, shows the controller according to FIG. 6.

The bore 26, which, as described above, may be constructed in the form of a drilled injection passage, may be disposed at any point whatever of the carburetor 100, such as in the main jet chamber 38, in the intake portion 40, or behind the carburetor in the inlet portion. Alternatively, the bore 26 may be located in the inlet portion 11*a*, in the carburetion portion 11 or in the post-inserted throttle valve portion 12. In the control means according to FIG. 7, the by-pass system operates as main supply system and the control system with the carburetor diaphragm remains responsible only for the idling function as a secondary system. Additional fuel for the acceleration, which up to now used to be made available in the underload jet chamber 25, is no longer required in this embodiment.

According to one embodiment of the invention, a fuel return line 60, with one of its ends 61, communicates with the fuel feed line 16 or with the filter chamber 20 in the carburetor 100, while the other end 62 with the suction head is mounted in the fuel tank 15. In this case, a restrictor 59 is installed in the fuel return line 60 to provide flow resistance (FIG. 1).

Figure 2:
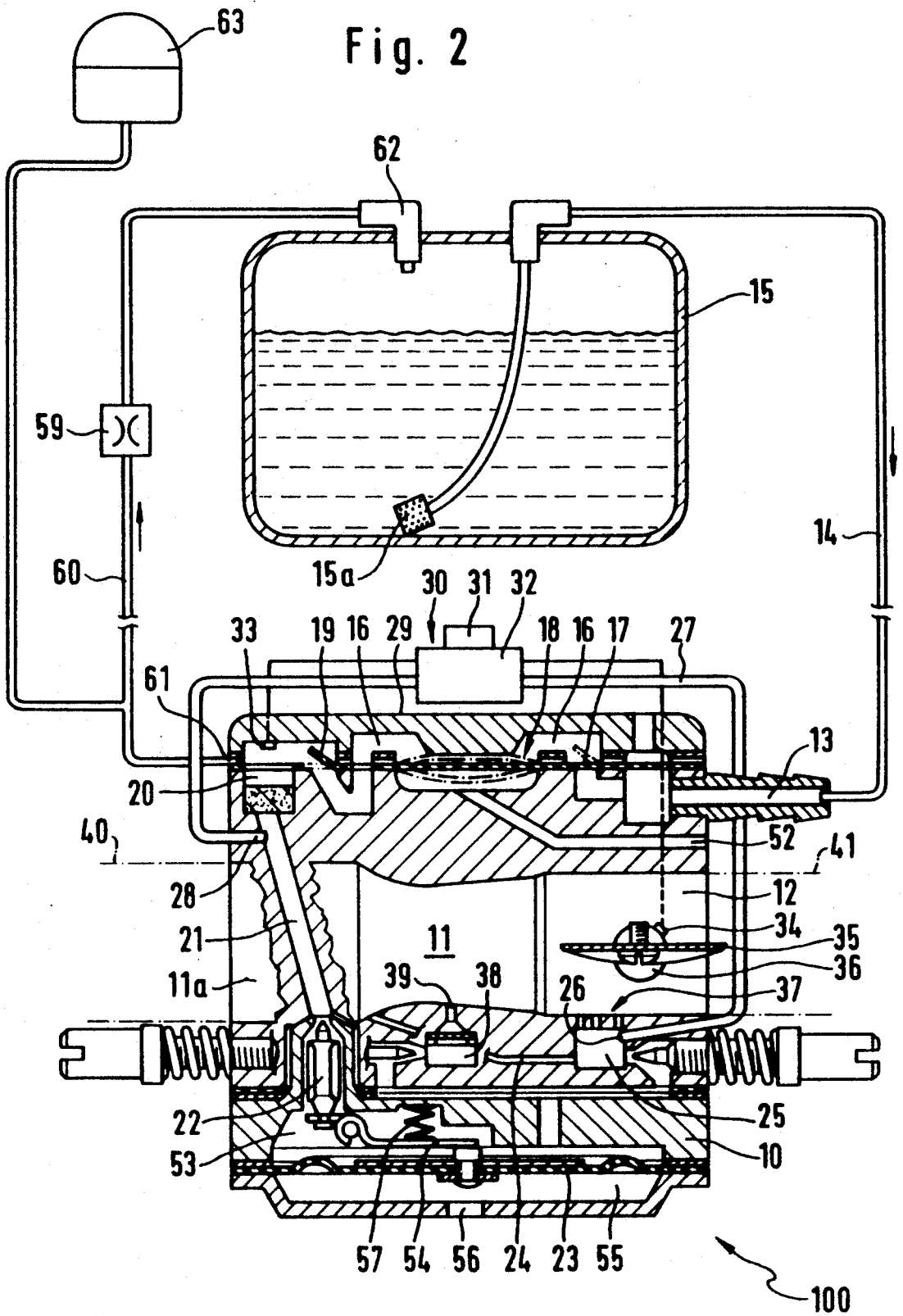
Figure 3:
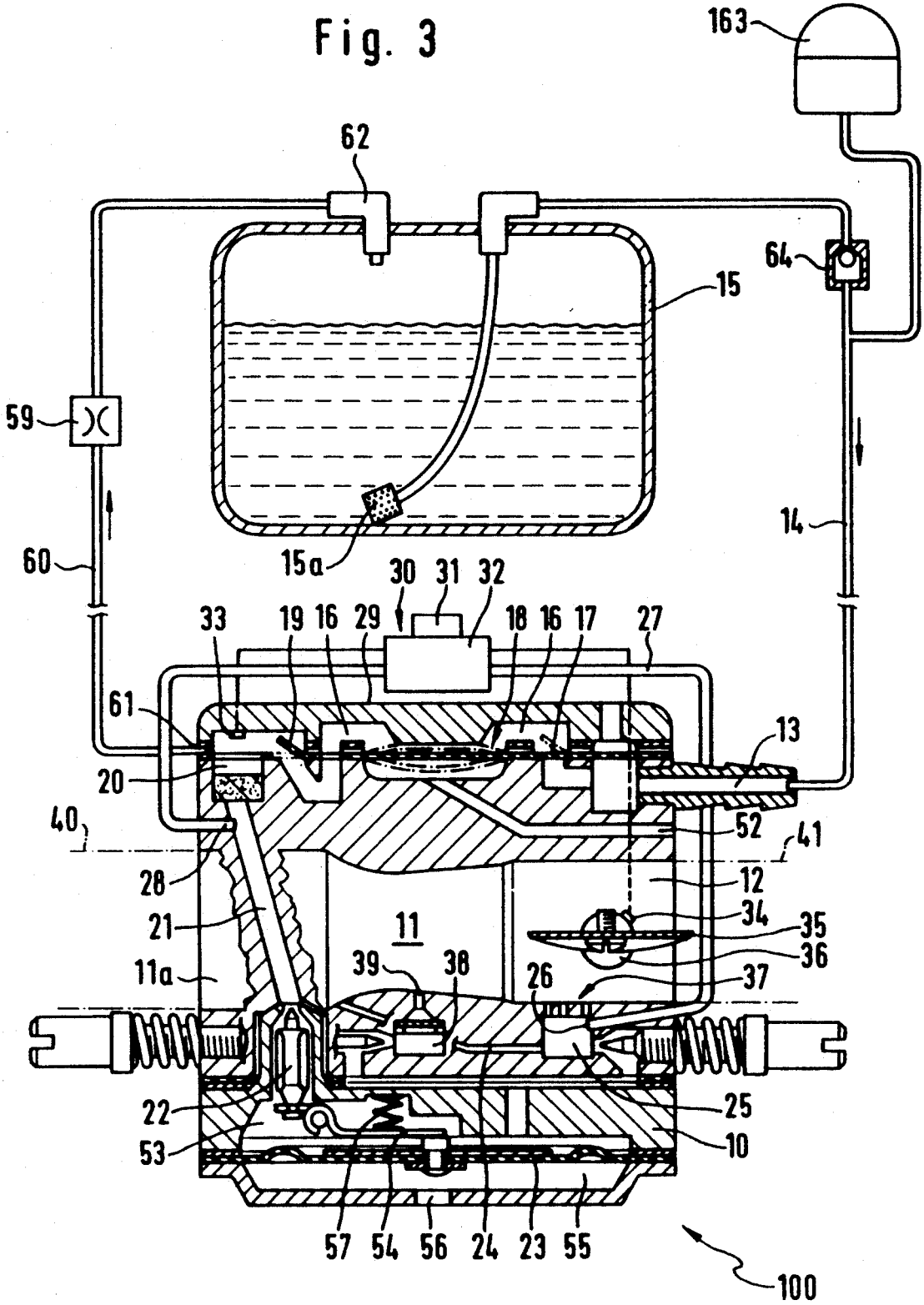
Figure 4:
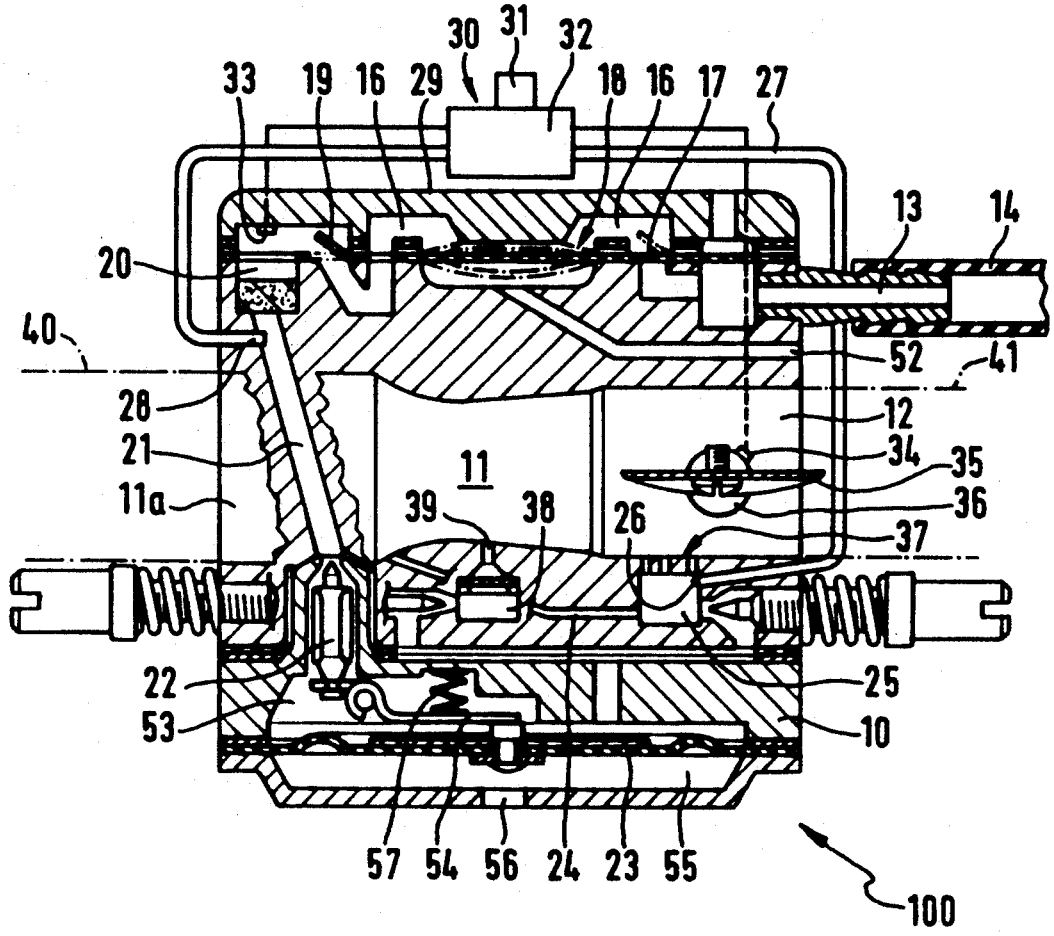
FIG. 4, in a vertical cross section, shows a diaphragm carburetor.

In the embodiment shown in FIG. 2, a primer is mounted between the end 61 and the restrictor 59. The primer may be constructed in the form of a suction primer. In the embodiment shown in FIG. 3, a primer 163 is installed in the fuel line 14, while a backflow check valve is disposed between the fuel tank 15 and the primer 163. When the primer is connected in series to the fuel line 14, the backflow check valve is disposed in the primer.

Figure 5:
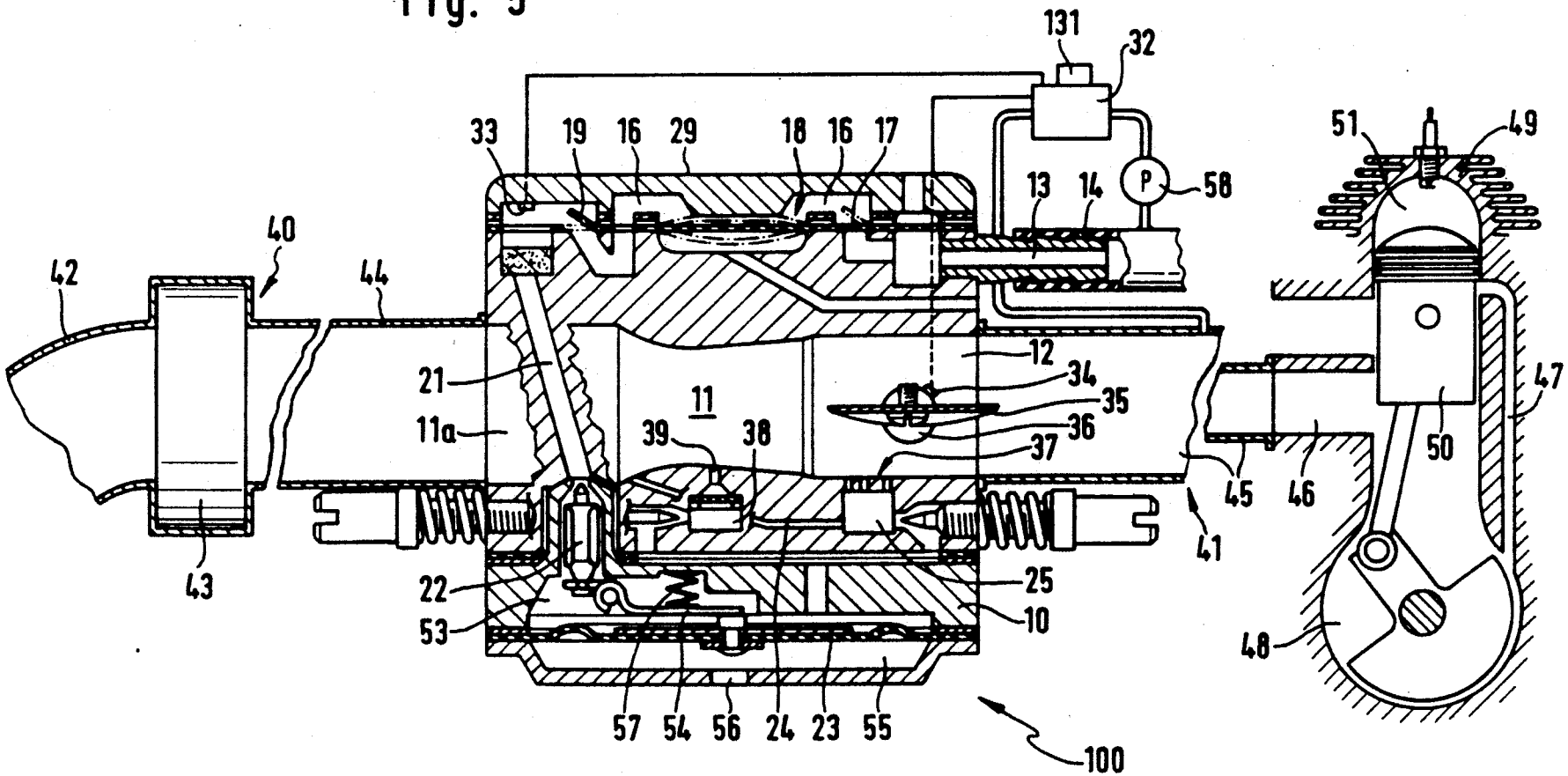
FIG. 5, in a vertical cross section, shows the mixture preparation section of an internal-combustion engine with a diaphragm carburetor.

The diaphragm carburetor shown in FIG. 5 essentially corresponds to the embodiment described in FIGS. 1 through 4 so that identical parts are identically designated. In this embodiment, however, an intake portion 40 and an inlet portion 41 are depicted with the pertinent parts of an internal-combustion engine.

In this embodiment the diaphragm carburetor 100 is disposed between an inlet portion and an intake portion 40. The intake portion 40 comprises an inlet connection piece 42, an air filter 43 and an intake manifold 44. The inlet portion comprises an intermediate flange 45, an induction port 46, a return passage 47 and a crankcase 48 for the combustion chamber 51 in cylinder 49 and enclosed by the piston 50.

The mode of operation of both embodiments shown in FIGS. 1 through 5 will now be described.

In the diaphragm carburetor 100, the fuel entering via the fuel line 14, is, in a pressurized state, pumped by the fuel pump 18 via the fuel supply line 16 into the filter chamber 20 and conveyed therefrom via the control chamber feed line 21 to the needle valve 22 which is regulated by the control diaphragm 23.

The fuel pump 18 is constructed in the form of a diaphragm pump which is actuated via the pulse line 52 which (not shown) communicates with the crankcase 48 of the internal-combustion engine. The direction of flow is predetermined by means of the diaphragm pump chamber inlet valve 17 constructed in the form of a flutter valve and the diaphragm pump chamber outlet valve 19. Thus, as soon as pressure pulses are generated in the crankcase 48, the fuel pump 18 begins to deliver fuel. The supply to the control chamber 53 is in this case regulated with the aid of the needle valve 22, which is connected to the control diaphragm by means of a rocker arm 54 acted upon by a spring 57. The control diaphragm 23 separates the control chamber 53 and the atmospheric air chamber 55 which, via the atmospheric air inlet 56, communicates with the ambient air. Hence, as soon as the pressure in the control chamber 53 is less than the pressure in the atmospheric air chamber 55, the inflow into the control chamber 53 is ensured by means of the control diaphragm 23 and the needle valve 22. The control chamber 23 supplies the fuel to the main jet chamber 38 as well as to the underload jet chamber 25. It is apparent that this system can be operative only when the pressure in the control chamber 53 is less than that in the atmospheric chamber 55. For example, an excess pressure may arise due to the formation of vapor bubbles in an overheated carburetor. Similarly, in the cold start phase, when the throttle valve is substantially closed, a situation may arise in which the pressure in the control chamber 53 exceeds that in the atmospheric chamber 55, so that the needle valve 22 blocks the flow of fuel.

It is precisely in this operating condition that the novel system of the present invention takes effect. Inside the intermediate flange 45, the additional drilled injection passage 26 constructed in the form of a jet is disposed which communicates with the feed line 27 on the outside of the housing. At its other end, the feed line 27 communicates with the feed line connection piece 28 which, in turn, communicates with the fuel line 14. Along the course of the feed line 27, on the outside 29 of the housing 10, the controller 30 is mounted which is constructed in the form of a check valve 32 regulated by a control switch 31. The sensor 33 of the control switch 31 is in this case disposed in the interior of the filter chamber 20. The sensor 34 of the control switch 31 is disposed on the throttle valve 12 and detects the position of the throttle valve. Along the course of the feed line 27, an additional fuel pump 58 is installed which may be driven mechanically, electrically or pneumatically.

When the control switch 31 is actuated in the embodiment according to FIGS. 1 through 4 and the sensors 33, 34 predetermine the pertinent control valves, fuel is removed from the filter chamber 20 via the feed line connection piece 28 and is supplied to the underload jet chamber 25 via the drilled injection passage 26 as soon as the fuel pump 18 builds up the appropriate pressure.

In the embodiment according to the FIG. 5, when the control switch 31 is actuated and the sensors 33, 34 preset the pertinent control values, fuel is removed from the fuel line 14 by means of the additional fuel pump 58 and the opened check valve 32 via the feed line connection piece 28. This fuel is supplied to the intermediate flange 45 via the drilled injection passage 26. The disposition of the drilled injection passage 26 in this embodiment is chosen only as an example. The passage 26 may alternatively be disposed in the induction port 46, in the return passage 47, in the crankcase 48 or in the combustion chamber 51.

It is likewise possible to dispose the additional drilled injection passage 26 in the intake portion, such as in the intake connection piece 42, or in the air filter 43 with intake manifold 44 communicating with the carburetor 100. In such on embodiment it is necessary only to provide for the throttle valve 35 to be appropriately opened in the starting phase and during the necessary additional mixture enrichment via the drilled injection passage 26.

In order to supply additional fuel via the feed line 27 and, if necessary, to prevent flooding of the respective part of the internal-combustion engine, the drilled injection passage 26 is preferably constructed so that its flow diameter is smaller when compared with the first or the second underload jet 8*a*.

The controller 30 and the feed line 27 communicating therewith do not necessarily have to be disposed in the manner indicated in the drawing.

Alternatively, it may be advantageous when the controller 30, especially when it is constructed in the form of a manually operable check valve, is mounted directly on the carburetor. For the function of the cold and hot starting device it is highly important that the feed line 27 communicates with a part of the fuel supply and that an additional fuel injection takes place.

Figure 6:
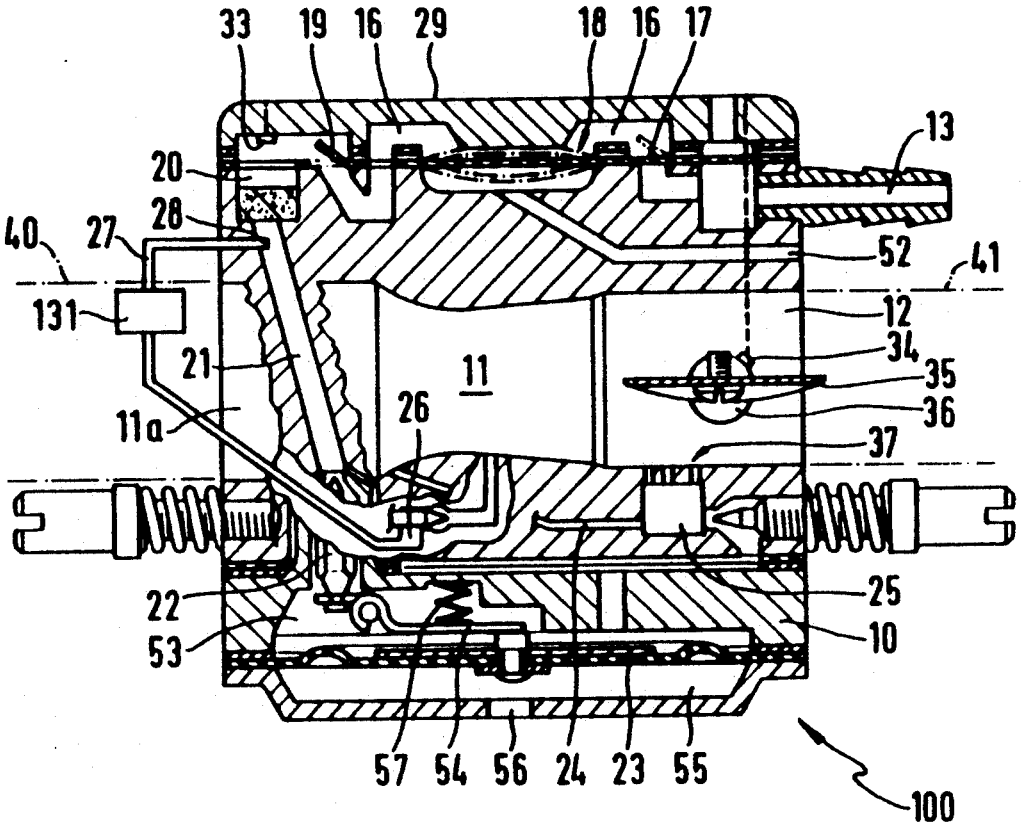
FIG. 6, in a vertical section, shows a further embodiment of the diaphragm carburetor according to the present invention.

The drilled injection passage 26, which, as described above is preferably constructed in the form of a drilled jet, may also be disposed at any point within the carburetor. For example, passage 21 may be disposed in the inlet portion 41, in the carburetion portion (Venturi) or within the area of the throttle valve 35. The drilled injection passage 26 may also be disposed in the carburetion portion 11 in such a way that the drilled injection passage 26 may be operated as a main jet. With the aid of the controlling means, the by-pass system may operate as the main feed system and the control system with the diaphragm carburetor may be used only as a secondary system, as is illustrated in FIG. 6. In this case the construction of the carburetor is, in principle, the same as in FIG. 1, so that reference is made to the reference numbers employed there; however, the feed line 27 communicates with the main jet 26 directly and is flow-controlled by means of the control switch 131 depicted in FIG. 7. The control switch 131, which is constructed in the form of a stop valve, is connected to the throttle valve 35 by means of an indicated linkage and is adjusted depending upon the position of the throttle valve 35. It is also possible here to provide a further control switch 231, which may operate to interrupt the fuel flow after the engine has flooded.

Figure 8:
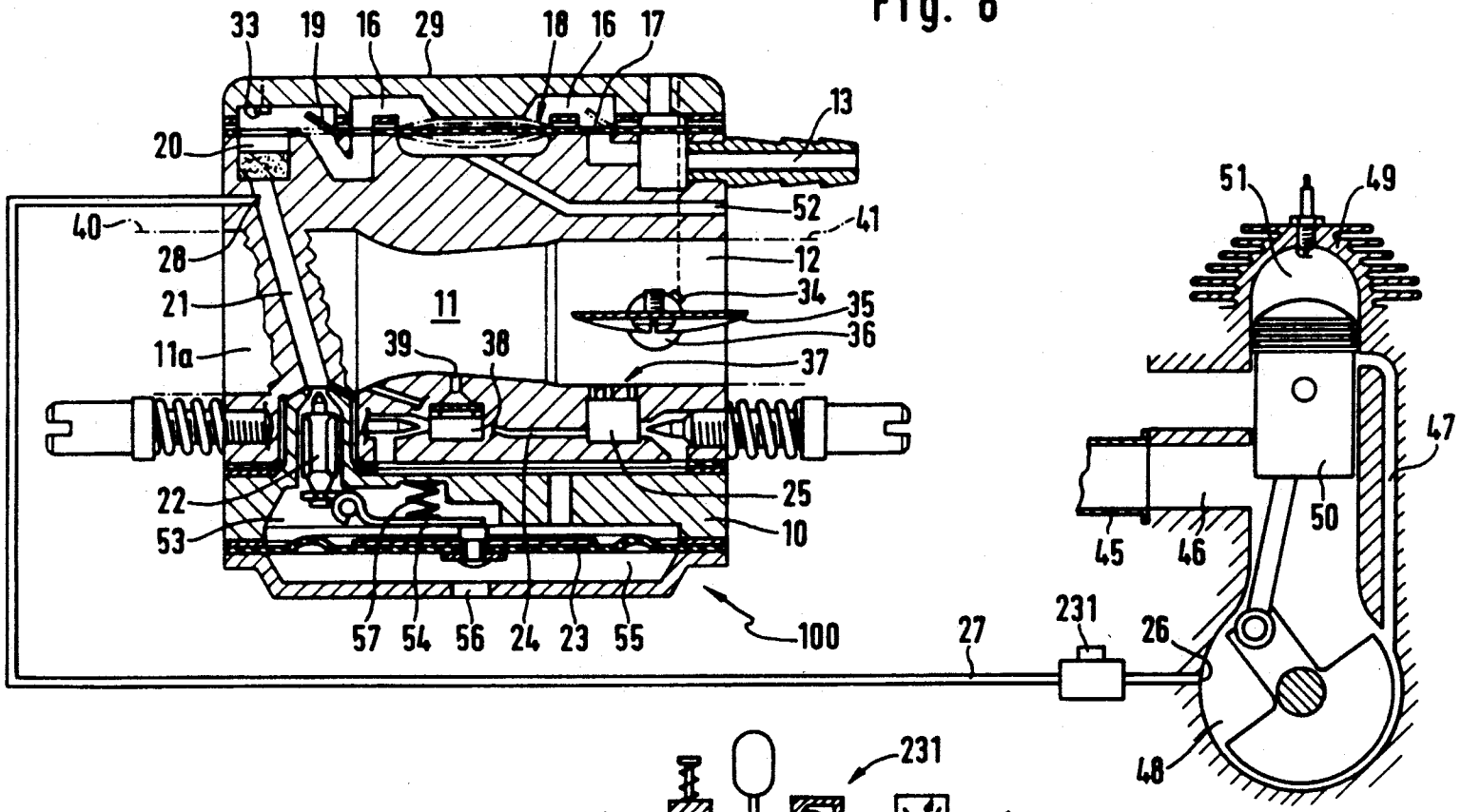
FIG. 8, in a vertical cross-section, shows a further embodiment of the mixture preparation section of the internal-combustion engine with a diaphragm carburetor, and FIG. 9, in an enlarged diagrammatical representation, shows the controller according to FIG. 8.
Figure 9:
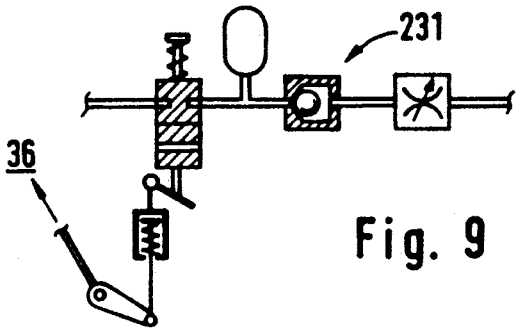

In the embodiment depicted in FIG. 8, the basic construction of the carburetor is, in principle, likewise the same as in FIG. 1 so that reference is made to the reference numbers used there; however, in this embodiment, the feed line 27 communicates with the crankcase 48 directly and is flow-controlled with the aid of the control switch 231 shown in FIG. 6. The disposition of the drilled injection passage 26 is in this case selected merely as an example since it may alternatively be disposed in the induction port 46, in the return passage 47, in the crankcase 48, or even in the combustion chamber 51. In this case the control switch 231 is embodied by means of the control elements known in the art and symbolically illustrated in FIG. 9 and is connected to the throttle valve 35 by means of an indicated linkage and is adjusted depending upon the position of the throttle valve 35. The control switch 23 is connected to the throttle valve 35 by means of a linkage and is adjustable depending upon the position of the throttle valve 35.

Although the foregoing description contains many specificities these should not be construed as limiting the scope of the invention but as merely providing illustrations of some of the presently preferred embodiments of this invention. Accordingly, the scope of the invention should be determined by the appended claims and their legal equivalents.

What is claimed is:

1. An internal-combustion engine comprising:

an inlet portion communicated to atmosphere;

a carburetion portion connected to said inlet portion having a first fuel inlet for injecting fuel to air passing through said carburetor portion;

a combustion portion of said engine communicated to said carburetion portion for combusting said air fuel mixture from said carburetor;

a throttle valve for controlling the amount of said air flowing through said carburetor portion;

a fuel feed line communicated to a source of fuel at one end and to a fuel pump at the other end;

a fuel pump having an inlet and an outlet for pumping fuel from said source of fuel;

a first fuel flow controller between the outlet of said fuel pump and said first fuel inlet, said fuel flow controller including a diaphragm having atmospheric pressure acting on one side thereof and pressure from said engine acting on the other side thereof to open and close fuel to said first fuel inlet;

a starting and controlling device including:

a second fuel line having an inlet communicated to the pressure discharge side of said fuel pump between said fuel flow controller and the outlet of said fuel pump and having a second fuel outlet discharging to said combustion portion of said engine at the other end thereof;

a second fuel flow controller in said second fuel line for opening and closing said second fuel line, said second fuel flow controller having:

first means for opening said second fuel line responsive to pressure from said engine closing said first fuel flow controller; and, second means for opening said second fuel line responsive to movement of said throttle valve;

whereby said second fuel line provides an alternate fuel supply from said fuel pump to said combustion portion of said engine; and, a fuel return line which communicates at one end with the outlet of said fuel pump and at the other end, communicates with the fuel supply and, along the course of which a flow resistance is disposed for returning excess fuel from said pump to said fuel supply.

2. The internal combustion engine of claim 1 and including a primer in said return fuel line.

3. The internal combustion engine of claim 1 and including a primer in said fuel line between said fuel pump inlet and said source of fuel.

4. The internal combustion engine of claim 1 and including a back flow check valve between said fuel pump inlet and said source of fuel.

5. The internal combustion engine of claim 1 and said second fuel inlet is in said carburetion portion of said engine.

6. The internal combustion engine of claim 1 and said second fuel inlet is an underload jet.

7. The internal combustion engine of claim 1 and wherein said fuel flow controller includes a manually actuable check valve.

8. The internal combustion engine of claim 1 and wherein said fuel flow controller includes an electronically controlled check valve.

9. The internal combustion engine of claim 1 and wherein said fuel flow controller includes means for detecting throttle valve position.

* * * * *